US011569012B2

(12) United States Patent
Chen et al.

(10) Patent No.: US 11,569,012 B2
(45) Date of Patent: Jan. 31, 2023

(54) METHOD FOR IMPROVING PERFORMANCE OF SINTERED NDFEB MAGNETS

(71) Applicant: Yantai Shougang Magnetic Materials Inc, Yantai (CN)

(72) Inventors: Xiulei Chen, Yantai (CN); Zhongjie Peng, Yantai (CN); Xiaonan Zhu, Yantai (CN); Chunjie Xiang, Yantai (CN); Kaihong Ding, Yantai (CN)

(73) Assignee: Yantai Dongxing Magnetic Materials Inc., Yantai (CN)

( * ) Notice: Subject to any disclaimer, the term of this patent is extended or adjusted under 35 U.S.C. 154(b) by 33 days.

(21) Appl. No.: 17/083,341

(22) Filed: Oct. 29, 2020

(65) Prior Publication Data

US 2021/0134498 A1 May 6, 2021

(30) Foreign Application Priority Data

Nov. 6, 2019 (CN) ..... 201911076518.2

(51) Int. Cl.

| | |
|---|---|
| ***H01F 1/057*** | (2006.01) |
| ***B22F 9/04*** | (2006.01) |
| ***B22F 1/145*** | (2022.01) |

(52) U.S. Cl.

CPC ..... *H01F 1/0577* (2013.01); *B22F 1/145* (2022.01); *B22F 2201/013* (2013.01)

(58) Field of Classification Search

None

See application file for complete search history.

(56) References Cited

U.S. PATENT DOCUMENTS

| | | | | |
|---|---|---|---|---|
| 5,643,491 | A * | 7/1997 | Honkura | H01F 1/0573 420/83 |
| 2015/0239048 | A1* | 8/2015 | Nagata | H01F 1/0571 241/39 |
| 2016/0012946 | A1* | 1/2016 | Horikita | H01F 1/0573 148/101 |

FOREIGN PATENT DOCUMENTS

| | | | |
|---|---|---|---|
| CN | 1157051 | A | 8/1997 |
| CN | 1360317 | A | 7/2002 |
| CN | 103545079 | A | 1/2014 |
| CN | 105316580 | A | 2/2016 |
| CN | 106504838 | A | 3/2017 |
| CN | 108806912 | A | 11/2018 |
| CN | 106252012 | B | 1/2019 |
| CN | 109243746 | A | 1/2019 |
| CN | 109346259 | A | 2/2019 |
| JP | 2008305908 | A | 12/2008 |
| JP | 201617203 | A | 8/2017 |
| KR | 20170070530 | A | 6/2017 |
| WO | 2016047593 | A | 6/2017 |

OTHER PUBLICATIONS

Corresponding JP application search results issued on Oct. 15, 2020.

* cited by examiner

*Primary Examiner* — Xiaowei Su
(74) *Attorney, Agent, or Firm* — Gang Yu

(57) ABSTRACT

The present disclosure relates generally to a method for improving the performance of sintered NdFeB magnet. A method of preparing a sintered NdFeB magnet therefore comprises the steps of: a) preparing alloy flakes from a raw material of the NdFeB magnet by a strip casting process; and b) preparing a coarse alloy powder from the alloy flakes by a hydrogen decrepitation process, the hydrogen decrepitation process including treatment of the alloy flakes under a hydrogen pressure of 0.10 MPa to 0.25 MPa for a duration of 1 to 3.5 hours, then degassing the hydrogen at a predetermined temperature between 300° C. to 400° C. for a duration time of 0.5 to 5 hours, and then mixing the resulting coarse alloy powder with a lubricant.

6 Claims, No Drawings

METHOD FOR IMPROVING PERFORMANCE OF SINTERED NDFEB MAGNETS

CROSS-REFERENCE TO RELATED PATENT APPLICATIONS

The present application claims the priority of Chinese Patent Application No. 201911076518.2, filed on Nov. 6, 2019, the disclosures of which are incorporated herein by reference in their entirety.

TECHNICAL FIELD

The present disclosure relates generally to a method for improving the performance of sintered NdFeB magnet.

BACKGROUND

NdFeB magnets are widely used in storage equipment, electronic components, wind power generation, motors and other fields due to their excellent magnetic properties. With the expansion of application fields, in order to using under harsh conditions and meet their magnetic performance requirements, the magnetic properties need to be further improved. At present, the remanence of industry NdFeB products can reach about 90% of the theoretical saturation magnetization of NdFeB, but the coercivity is still difficult to reach one third of the theoretical value without adding heavy rare earth element. There is a large improvement potential.

The most effective way to improve the coercivity of neodymium iron boron magnets is adding heavy rare earth elements like Dy, Tb, etc., to replace the Nd element in Nd2Fe14B phase. The magnetocrystalline anisotropy field constant of Nd2Fe14B is $H_A$=5600 kA/m, the magnetocrystalline anisotropy field constant of Dy2Fe14B is $H_A$=12000 kA/m, and the magnetocrystalline anisotropy field constant of Tb2Fe14B is $H_A$=17600 kA/m. Substitution of heavy rare earth elements can significantly increase the coercivity of neodymium iron boron magnets. However, the price of heavy rare earths is relatively high. In order to reduce the usage of heavy rare earth elements, grain boundary diffusion process is usually used. However, due to the limited diffusion depth, this method is only suitable for thin magnetic samples.

In order to reduce the cost of raw materials and reduce the usage of heavy rare earth, optimizing the process in every step has become an important direction. In recent years, the grain refinement process has become an important trend in the sintered NdFeB industry. In order to obtain finer magnetic powder, the commonly used process in industry is to carry out hydrogen crushing treatment on the NdFeB alloy, and then use jet mill for powder production. After forming, sintering, aging and other processes, a neodymium iron boron magnet is finally obtained. In the process of jet milling, NdFeB magnetic powder crushed by hydrogen is easily oxidized and nitrided because of surface area increasing. The refinement of magnetic powder can improve the magnetic performance, but the increase in oxygen and nitrogen content will sacrifice a part of the magnetic properties.

Chinese patent CN106504838A provides a process of dehydrogenation at 550° C. to 600° C. and controlling the dehydrogenation time below 8 hours. The purpose is to make the hydrogen treatment powder have a higher hydrogen content which can increase the brittleness of the hydrogen treatment powder, and then improve milling efficiency.

Chinese patent CN106683814B refers to a process of dehydrogenation after jet milling. The process improves the efficiency of milling, and at the same time, the hydride plays a protective role in the grinding process, which can reduce oxidation and nitridation content in the powders. Dehydrogenation after grinding can also improve the orientation degree of the magnetic powders during forming and orientation process. However, in the traditional dehydrogenation process, condensing the dehydrogenation time at 500° C. to 600° C. can also achieve the purpose of partial dehydrogenation. But in this method residual hydrogen element will exist in the form of $Nd_2Fe_{14}BH_x$ and Re—$H_y$. $Nd_2Fe_{14}BH_x$ will affect the orientation degree of magnetic powders during forming and orientation process. That is bad for increasing the remanence of the magnet. And also, cracks will come out during the subsequent sintering process because of excessive dehydrogenation rate. If the hydrogen is completely dehydrated after grinding, the magnetic powder will be easily oxidized and azotized without protection of reasonable hydrogen content. At the same time, the amount of residual carbon introduced by the lubricant will increase, which is not good for magnetic properties.

SUMMARY

The disclosure provides a method of preparing a sintered NdFeB magnet, said method comprising the steps of:

a) preparing alloy flakes from a raw material of the NdFeB magnet by a strip casting process, optionally rough crushing the NdFeB alloy flakes; and b) preparing a coarse alloy powder from the alloy flakes by a hydrogen decrepitation process, the hydrogen decrepitation process including treatment of the alloy flakes under a hydrogen pressure of 0.10 MPa to 0.25 MPa for a duration of 1 to 3.5 hours, then degassing the hydrogen at a predetermined temperature between 300° C. to 400° C. for a duration time of 0.5 to 5 hours, and then mixing the resulting coarse alloy powder with a lubricant.

According to one embodiment, in step b) degassing hydrogen may be performed at a temperature between 340° C. to 380° C. for a duration of 1 to 3 hours. In addition or alternative, degassing hydrogen may be performed until the hydrogen content in the coarse alloy powder is between 300 ppm to 850 ppm.

The present disclosure thus provides a method including steps of: preparing NdFeB alloy flakes form a raw material, optionally rough crushing the NdFeB alloy flakes, hydrogen absorbing the (rough crushed) alloy flakes, and then dehydrogenation treatment at special conditions, adding lubricant to the coarse alloy powder achieved by the hydrogen decrepitation process, using jet mill to grind the coarse alloy powder with nitrogen as carrier gas to obtain a fine magnetic powder; mix lubricant into the magnetic powder, go through the process of magnetic field orientation, forming, cold isostatic pressing, sintering, aging, etc. to obtain the desired sintered NdFeB magnet.

According to another embodiment, which could be also combined with each of the above mentioned embodiments, the method may further include step c) following step b):

c) preparing a fine magnetic powder from the coarse alloy powder by a jet milling process, wherein nitrogen is used as carrier gas in the jet milling process and the fine magnetic powder is mixed with a lubricant.

According to another embodiment, which could be also combined with each of the above mentioned embodiments, the method may further include step d) following step c):

d) molding the fine magnetic powder mixed with lubricant into a compact, wherein the step of molding includes orienting the powder under a magnetic field and then subjecting the compact to a cold isostatic treatment.

Molding may be further defined as after the forming process the unit weight of the compact is no more than 600 g.

According to another embodiment, which could be also combined with each of the above mentioned embodiments, the method may further include step e) following step d):

e) sintering and aging the compact to obtain the sintered NdFeB magnet, wherein the step of sintering further includes a step of heating to 250° C. for a duration of 2 hours, then heating to 550° C. for a duration of 2 hours, then heating to 750° C. for a duration of 2 hours, and finally raising the temperature to 1010° C. to 1040° C. for a duration of 2 to 5 hours.

A heating rate from 550° C. to 750° C. may be between 1° C./min to 4° C./min, in particular between 2° C./min to 3° C./min.

Another aspect of the present disclosure is to provide a sintered NdFeB magnet obtained by the above-mentioned method. Further preferred embodiments of the disclosure could be learned from the following description.

DETAILED DESCRIPTION OF THE EMBODIMENTS

In step b), firstly the alloy flakes are performed in a hydrogen decrepitation process under a predetermined hydrogen pressure of between 0.10 MPa to 0.25 MPa and for a duration time of 1 to 3.5 hours. Then the dehydrogenation temperature is set to be between 300° C. to 400° C. and the dehydrogenation time is between 0.5 to 5 hours. The main reaction occurring under such a condition is $Re_2Fe_{14}BH_x$+Re—$H_y$—$Re_2Fe_{14}B$+x/2$H_2$+Re—$H_y$. Thus, the dehydrogenation reaction occurs mainly in $Re_2Fe_{14}BH_x$ phase (e.g. $Nd_2Fe_{14}BH_2$), while the dehydrogenation reaction of Re—$H_y$ phase (e.g. $NdH_2$) hardly occurs. In the process of jet milling following step b), the rare earth-rich phase which is easier to be oxidized and azotized, exists in the form of Re—$H_y$. Thus, the specific degasing conditions can effectively reduce the oxidation and nitridation rate of the fine magnetic powder achieved by the jet milling. At the same time, the rare earth-rich phase in the form of hydride can improve the milling efficiency.

During the subsequent forming and orientation process, the $Nd_2Fe_{14}B$ phase basically does not contain hydrogen, which is beneficial to improve the orientation of the magnetic powder and increase the remanence of the magnet. Cold isostatic treatment can make the green body more uniform in density and stress, especially when the hydrogen content is higher.

During the sintering process, the reaction Re—$H_y$-Re+y/2$H_2$ occurs around a temperature of 750° C. The released hydrogen may combine with the remaining carbon elements in the magnetic powder to form hydrocarbons and discharge from the blanks, reducing the content of carbon in the blanks. This is beneficial to increase magnetic performance of the magnet.

When heating from 550° C. to 750° C., controlling the heating rate in a special range can effectively prevent the occurrence of micro-cracks in the magnet due to excessive dehydrogenation, thus ensuring the mechanical properties of the magnet.

DESCRIPTION OF EMBODIMENTS

To have a better understanding of the present disclosure, the examples set forth below provide illustrations of the present disclosure. The examples are only used to illustrate the present disclosure and do not limit the scope of the present disclosure.

Implementing Example 1

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method and then the alloy flakes are disintegrated to produce an alloy powder. The step of disintegrating is further defined as subjecting the alloy flakes in a hydrogen decrepitation process under a hydrogen pressure of 0.10 MPa for a duration of 3.5 hours. The step of disintegrating further includes a step of degassing the hydrogen at a predetermined temperature of 300° C. for a duration of 0.5 hour. After dehydrogenation the hydrogen content in the hydrogen treatment alloy powder is tested. The hydrogen treatment alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with the conventional ester lubricant having a weight content of 0.10 wt. %. The fine magnetic powder mixed with lubricant is then molded into a compact. The step of molding includes orienting the powder under a magnetic field of 1.8 T. The unit weight of the compact is 600 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 1° C./min. Finally, the temperature is raised to 1010° C. for a duration of 5 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Five samples have been tested separately.

TABLE 1

Testing results of Implementing Example 1

| | H content in coarse alloy powder (ppm) | H content in magnet (ppm) | C content in magnet (ppm) | N content in magnet (ppm) | Br(T) | Hcj (kA/m) | bending strength (MPa) |
|---|---|---|---|---|---|---|---|
| 1 | 850 | 3 | 550 | 322 | 1.315 | 1791 | 420 |
| 2 | 835 | 4 | 575 | 363 | 1.320 | 1783 | 416 |
| 3 | 795 | 3 | 569 | 344 | 1.309 | 1799 | 433 |
| 4 | 816 | 6 | 565 | 375 | 1.316 | 1807 | 417 |
| 5 | 785 | 8 | 535 | 368 | 1.314 | 1807 | 418 |
| ave | 816 | 5 | 559 | 354 | 1.315 | 1797 | 421 |

TABLE 2

Testing results of Implementing Example 2

| | H content in coarse alloy powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 350 | 3 | 625 | 422 | 1.325 | 1759 | 417 |
| 2 | 335 | 4 | 675 | 463 | 1.322 | 1783 | 416 |
| 3 | 375 | 3 | 664 | 434 | 1.319 | 1743 | 423 |
| 4 | 316 | 3 | 665 | 475 | 1.318 | 1775 | 410 |
| 5 | 300 | 7 | 635 | 432 | 1.324 | 1767 | 418 |
| ave | 335 | 4 | 653 | 445 | 1.322 | 1766 | 417 |

Implementing Example 2

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.25 MPa for a duration of 1 hours. The step of disintegrating further includes a step of degassing the hydrogen at a predetermined temperature of 400° C. for a duration of 5 hour. After dehydrogenation, the hydrogen content in the hydrogen treatment alloy powder is tested. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 600 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 4° C./min. Finally, the temperature is raised to 1040° C. for a duration of 2 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

Implementing Example 3

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.1 MPa for a duration of 3.5 hours. The step of disintegrating further includes a step of degassing the hydrogen at a predetermined temperature of 360° C. for a duration of 2 hour. After dehydrogenation, the hydrogen content in the hydrogen treatment alloy powder is tested. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 400 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 2.5° C./min. Finally, the temperature is raised to 1040° C. for a duration of 2 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

TABLE 3

Testing results of Implementing Example 3

| | H content in coarse alloy powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 480 | 3 | 625 | 422 | 1.322 | 1791 | 416 |
| 2 | 515 | 5 | 575 | 413 | 1.322 | 1783 | 427 |
| 3 | 475 | 3 | 611 | 434 | 1.319 | 1775 | 431 |
| 4 | 516 | 5 | 635 | 375 | 1.316 | 1775 | 417 |
| 5 | 523 | 7 | 620 | 395 | 1.322 | 1791 | 419 |
| ave | 502 | 5 | 613 | 408 | 1.320 | 1783 | 422 |

TABLE 4

Testing results of Implementing Example 4

| | H content in coarse alloy powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 501 | 4 | 595 | 431 | 1.323 | 1767 | 419 |
| 2 | 478 | 6 | 605 | 423 | 1.321 | 1783 | 426 |
| 3 | 475 | 3 | 618 | 439 | 1.316 | 1759 | 433 |
| 4 | 511 | 7 | 629 | 390 | 1.319 | 1775 | 417 |
| 5 | 503 | 4 | 633 | 401 | 1.324 | 1767 | 427 |
| ave | 494 | 5 | 616 | 417 | 1.321 | 1770 | 424 |

Implementing Example 4

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.2 MPa for a duration of 2 hours. The step of disintegrating further includes a step of degassing the hydrogen at a predetermined temperature of 350° C. for a duration of 3 hour. After dehydrogenation, the hydrogen content in the hydrogen treatment alloy powder is tested. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 500 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 2° C./min. Finally, the temperature is raised to 1040° C. for a duration of 3 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

Comparative Example 1

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.1 MPa for a duration of 3.5 hours. The step of disintegrating further includes a step of degassing the hydrogen at a predetermined temperature of 550° C. for a duration of 5 hour. After dehydrogenation, the hydrogen content in the hydrogen treatment alloy powder is tested. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 600 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 2.5° C./min. Finally, the temperature is raised to 1040° C. for a duration of 2 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

TABLE 5

Testing results of Comparative Example 1

| | H content in coarse alloy powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 70 | 6 | 881 | 699 | 1.321 | 1695 | 426 |
| 2 | 77 | 4 | 842 | 645 | 1.322 | 1727 | 418 |
| 3 | 65 | 4 | 831 | 703 | 1.319 | 1703 | 435 |
| 4 | 69 | 3 | 902 | 721 | 1.321 | 1727 | 426 |
| 5 | 69 | 5 | 876 | 706 | 1.324 | 1711 | 419 |
| ave | 70 | 4 | 866 | 695 | 1.321 | 1713 | 425 |

TABLE 6

Testing results of Comparative Example 2

| | H content in fine magnet powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 55 | 3 | 887 | 338 | 1.322 | 1743 | 418 |
| 2 | 65 | 6 | 832 | 343 | 1.322 | 1759 | 418 |
| 3 | 58 | 5 | 831 | 344 | 1.319 | 1727 | 429 |
| 4 | 58 | 4 | 865 | 319 | 1.316 | 1759 | 427 |
| 5 | 59 | 4 | 896 | 321 | 1.322 | 1735 | 432 |
| ave | 59 | 4 | 862 | 333 | 1.320 | 1745 | 425 |

Comparative Example 2

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.1 MPa for a duration of 3.5 hours. No dehydrogenation was performed after the hydrogen decrepitation process. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. The fine magnetic powder is treated at a predetermined temperature of 550° C. for a duration of 5 hour for degassing the hydrogen. After dehydrogenation, the hydrogen content in the fine magnetic powder is tested. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 600 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 2.5° C./min. Finally, the temperature is raised to 1040° C. for a duration of 2 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

Comparative Example 3

A raw material is used including Nd—Pr being present at 31.0 wt. %, B being present at 0.96 wt. %, Al being present at 0.45 wt. %, Co being present at 1.0 wt. %, Cu being present at 0.15 wt. %, Ga being present at 0.10 wt. %, Dy being present at 1.50 wt. %, Ti being present at 0.08 wt. %, and Fe being present as a balance, and unavoidable impurities. The raw material is made into alloy flakes by a strip casting process and then coarsely broken by a mechanical method. Then the alloy flakes are disintegrated to produce a coarse alloy powder. The step of disintegrating is further defined as subjecting the alloy flakes in a hydrogen decrepitation process under a hydrogen pressure of 0.1 MPa for a duration of 3.5 hours. The step of disintegrating further includes a step of degassing the hydrogen at a predetermined temperature of 360° C. for a duration of 2 hour. After dehydrogenation, the hydrogen content in the hydrogen treatment alloy powder is tested. The hydrogen treated coarse alloy powder is then mixed with a conventional ester lubricant having a weight content of 0.05 wt. %. Next, the coarse alloy powder with the lubricant is pulverized by subjecting the coarse alloy powder to a jet milling process using a carrier gas of nitrogen to produce a fine magnetic powder having an average particle size of 3.8 μm. Then, the fine magnetic powder is mixed with a conventional ester lubricant having a weight content of 0.10 wt. %. The powder mixed with lubricant is then molded into a compact. The step of molding includes orienting the powder under a magnetic field of 1.8 T. The unit weight of the compact is 750 g and then subjected to a cold isostatic treatment. The sintering and aging processes are carried out in a vacuum furnace, and the vacuum degree is below $5\times10^{-1}$ Pa. The step of sintering further includes a step of heating to 250° C. for a duration of 2 hours, then heating to 550° C. for a duration of 2 hours, and then heating to 750° C. for a duration of 2 hours. While the temperature rises from 550° C. to 750° C., the heating rate is controlled as 7° C./min. Finally, the temperature is raised to 1040° C. for a duration of 2 hours. After sintering a conventional aging treatment is subjected. Concentration of carbon and nitrogen and hydrogen element in the finally magnet is detected. The magnetic performance of the magnet is also tested. The magnet is cut into size of 5 mm*5 mm**35 mm for bending strength testing. Test five sets of data separately.

TABLE 7

Testing results of Comparative Example 3

| | H content in coarse alloy powder (ppm) | H content in magnet (ppm) | C content in magnet (ppm) | N content in magnet (ppm) | Br (T) | Hcj (kA/m) | bending strength (MPa) |
|---|---|---|---|---|---|---|---|
| 1 | 500 | 4 | 625 | 412 | 1.312 | 1767 | 388 |
| 2 | 502 | 4 | 575 | 413 | 1.309 | 1751 | 404 |
| 3 | 484 | 5 | 611 | 394 | 1.315 | 1743 | 395 |
| 4 | 512 | 6 | 635 | 393 | 1.311 | 1759 | 389 |
| 5 | 529 | 6 | 620 | 395 | 1.307 | 1767 | 411 |
| ave | 505 | 5 | 613 | 401 | 1.311 | 1758 | 397 |

Comparing Implementing Examples 1, 2, 3, 4 with Comparative Example 1, when the dehydrogenation process of the present disclosure is used, the hydrogen content in the hydrogen treatment powder is significantly higher than that after the conventional dehydrogenation process, which can effectively suppress the nitriding ratio of rare earth phase during the jet milling. This can significantly reduce the N content in the final magnet. The average N content corresponding to the Implementing Examples 1, 2, 3, and 4 are 354 ppm, 445 ppm, 408 ppm, and 417 ppm. Respectively, the N content of Comparative Example 1 is as high as 695 ppm.

The C content of the Implementing Examples 1, 2, 3, and 4 is also significantly lower than it in Comparative Example 1, indicating that the presence of a certain amount of hydrogen in the magnetic powder can play a role in decarburization during the sintering process.

At the same time, because the residual hydrogen in the magnetic powder does not exist in the main phase, it will not affect the orientation of the magnetic powder during the molding orientation process. Therefore, the Br of the sample of the Implementing Examples 1, 2, 3, and 4 has almost no decrease compared with the Comparative Example 1 and Comparative Example 2. However, the coercivity is greatly improved due to the decrease of N and C content.

Comparing Implementing Examples 1, 2, 3, 4 and Comparative Example 3, what can be seen is that controlling the heating rate from 550° C. to 750° C. between 1° C./min to 4° C./min can avoid the occurrence of microcracks in the magnet due to excessive dehydrogenation. The bending strength of magnet in the samples of Implementing Examples 1, 2, 3, and 4 is significantly higher than that of Comparative Example 3.

The control of the unit weight of the compact in the Implementing Examples is also to achieve better dehydrogenation during the sintering process and to improve the mechanical properties. Comparing the Implementing Examples with Comparative Example 2, also Comparative Example 2 reduces the N content in the magnet. But after dehydrogenation and the jet milling, the H content in the magnetic powder is too low to have the effect of decarburization. Therefore, the magnet of Comparative Example 2 has a higher carbon content and a lower coercivity.

In summary, the method provided in the present disclosure can effectively reduce the content of N and C in the magnet, which can improve the magnetic properties of sintered NdFeB magnet.

What is claimed is:

1. A method of preparing a sintered NdFeB magnet, said method comprising the steps of:

a) preparing alloy flakes from a raw material of the NdFeB magnet by a strip casting process; and b) preparing an alloy powder from the alloy flakes by a hydrogen decrepitation process, the hydrogen decrepitation process including treatment of the alloy flakes under a hydrogen pressure of 0.10 MPa to 0.25 MPa for a duration of 1 to 3.5 hours, then degassing the hydrogen at a predetermined temperature between 300° C. to 400° C. for a duration time of 0.5 to 5 hours, and then mixing the resulting alloy powder with a lubricant;

c) preparing a magnetic powder from the alloy powder by a jet milling process, wherein nitrogen is used as carrier gas in the jet milling process and the magnetic powder is mixed with a lubricant;

d) molding the magnetic powder mixed with lubricant into a compact, wherein the step of molding includes orienting the powder under a magnetic field and then subjecting the compact to a cold isostatic treatment;

e) sintering and aging the compact to obtain the sintered NdFeB magnet, wherein the step of sintering further includes a step of heating to and holding at 250° C. for a duration of 2 hours, then heating to and holding at 550° C. for a duration of 2 hours, then heating to and holding at 750° C. for a duration of 2 hours, and finally raising the temperature to 1010° C. to 1040° C. and holding at the temperature for a duration of 2 to 5 hours; wherein a heating rate from 550° C. to 750° C. is between 1° C./min to 4° C./min.

2. The method of claim 1, wherein in step b) degassing hydrogen is performed at a temperature between 340° C. to 380° C. for a duration of 1 to 3 hours.

3. The method of claim 1, wherein in step b) degassing hydrogen is performed until the hydrogen content in the alloy powder is between 300 ppm to 850 ppm.

4. The method of claim 2, wherein in step b) degassing hydrogen is performed until the hydrogen content in the alloy powder is between 300 ppm to 850 ppm.

5. The method of claim 1, wherein said step of molding is defined as after the forming process the unit weight of the compact is no more than 600 g.

6. The method of claim 1, wherein a heating rate from 550° C. to 750° C. is between 2° C./min to 3° C./min.

* * * * *